United States Patent [19]

Trice

[11] Patent Number: 4,813,264

[45] Date of Patent: Mar. 21, 1989

[54] AUTOMOTIVE BODY AND FRAME REPAIR DEVICE

[76] Inventor: John R. Trice, 5145 Bradfield Dr., Annandale, Va. 22003

[21] Appl. No.: 110,859

[22] Filed: Oct. 21, 1987

[51] Int. Cl.[4] ..... B21D 1/12

[52] U.S. Cl. ..... 72/447; 72/705

[58] Field of Search ..... 72/705, 447

[56] References Cited

U.S. PATENT DOCUMENTS

| | | | |
|---|---|---|---|
| 3,340,720 | 9/1967 | Chartier | 72/389 |
| 3,888,100 | 6/1975 | Chisum | 72/305 |
| 4,175,420 | 11/1979 | Kuhn | 72/705 |
| 4,398,410 | 8/1983 | McWhorter et al. | 72/457 |
| 4,501,136 | 2/1985 | Celette | 72/447 |
| 4,720,991 | 1/1988 | Kuhn | 72/705 |
| 4,747,579 | 5/1988 | Rich | 254/386 |

FOREIGN PATENT DOCUMENTS

| | | | |
|---|---|---|---|
| 2516410 | 5/1983 | France | 72/705 |

*Primary Examiner*—Robert L. Spruill

*Attorney, Agent, or Firm*—Laurence R. Brown; Alfred J. Mangels

[57] ABSTRACT

Apparatus for straightening automotive bodies and frames. The device includes a base and a hollow column within which an hydraulic cylinder is positioned. A top cap is applied to the column and includes a rotatable guide pulley about which a main tension chain passes for connection with an end of the hydraulic cylinder. A movable pulley housing is slidably carried along the column and includes a second guide pulley and a chain guide to guide a chain in a substantially horizontal direction outwardly from the movable pulley housing. A pair of outwardly extending arms are carried on another movable housing and include floating links on each lateral bar to permit the separate application of pulling forces independent of the main tension chain and along a line that does not pass through the column axis. The lateral arms can also be provided on the movable pulley housing. The disclosed structure permits the application of a plurality of pulling forces on an automotive frame or body, thereby permitting straightening operations to be performed without the necessity for repeatedly moving the column from one position to another in order to apply individual single pulling forces.

19 Claims, 6 Drawing Sheets

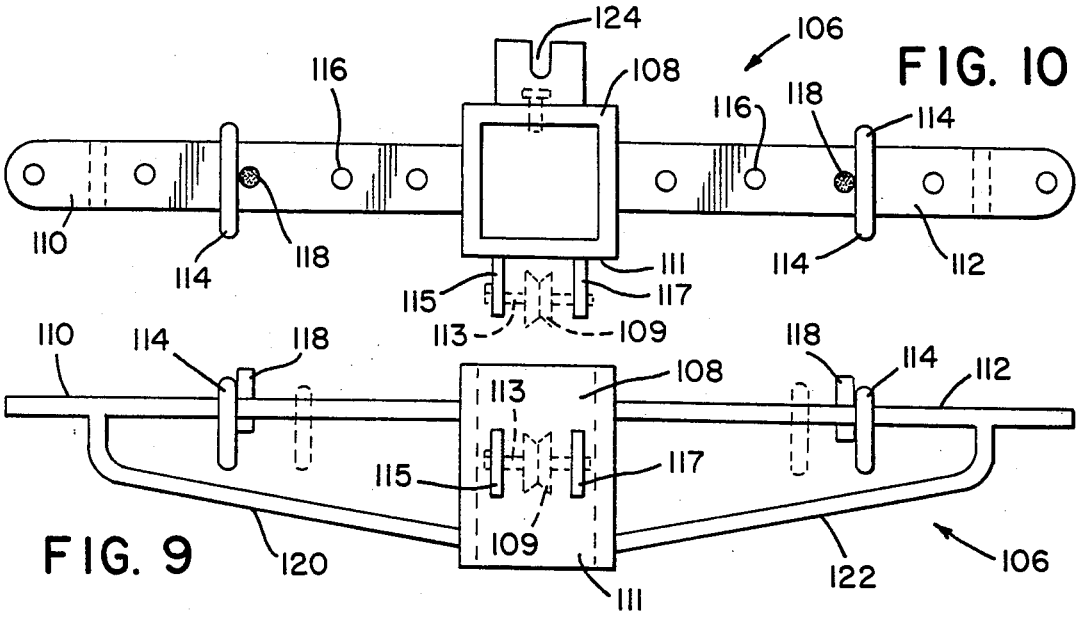
FIG. 10
FIG. 9
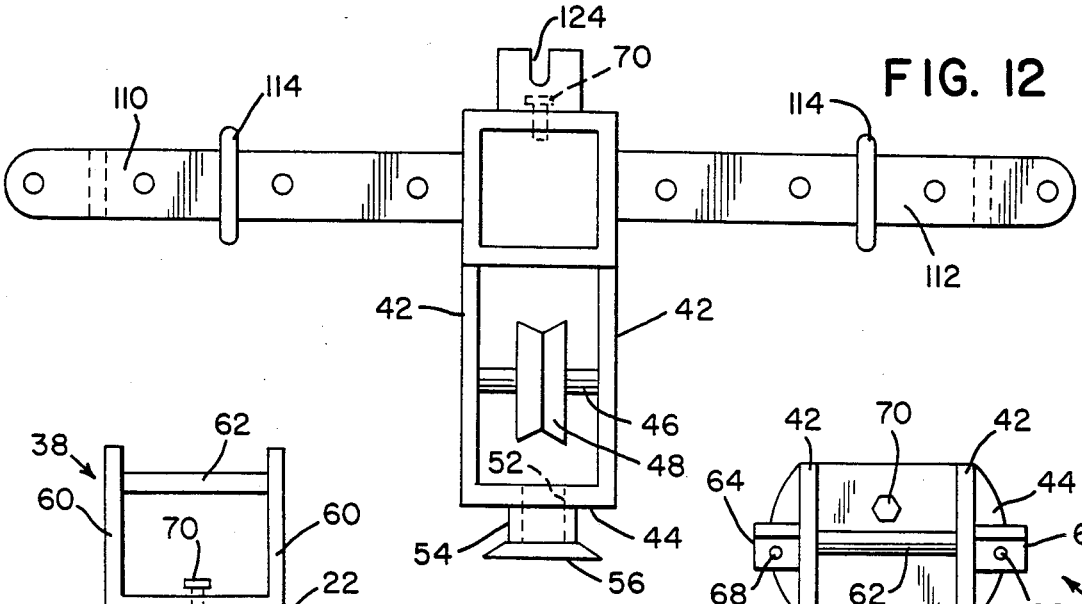
FIG. 12
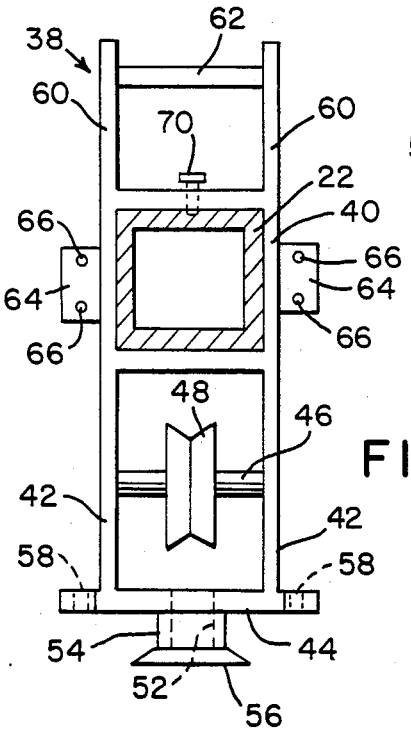
FIG. 2
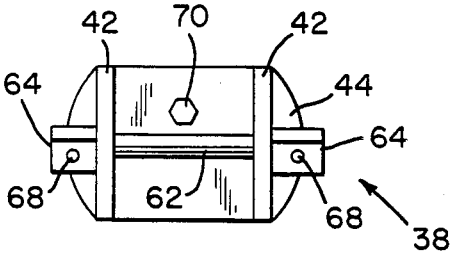
FIG. 4
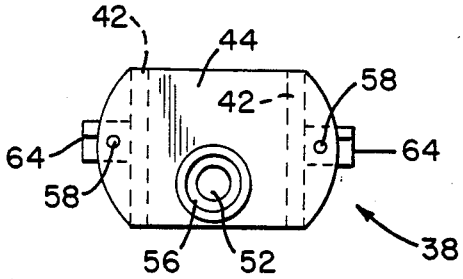
FIG. 3

AUTOMOTIVE BODY AND FRAME REPAIR DEVICE

BACKGROUND OF THE INVENTION

1. Field of the Invention

This invention relates to a device for repairing vehicle bodies and frames, and more particularly to a support column to which tension members cab be connected through hydraulic jacks to impose tension upon vehicle frame parts for purposes of straightening the parts, and also including connections for support members to absorb reaction forces imposed upon the column when the tension forces are applied to a stationary vehicle frame.

2. Description of the Related Art

Vehicle frames and bodies are often subjected to impact forces resulting from collisions either with other vehicles or with stationary objects. The results of such collisions are that various parts of the outer body structure, and possibly also the inner supporting frame structure, are deflected inwardly of the vehicle, and must therefore be pulled outwardly in order to restore the body and frame to its original form. In practice, the vehicle is restrained in position, and tension forces are applied to suitable points adjacent to where the deflection occured, in order to pull in an outward direction the body or frame part to which the tension is applied.

Various devices have been developed in the past for applying straightening forces to portions of vehicles, and in a desired force application direction. For example, in U.S. Pat. No. 3,340,720, which issued Sept. 12, 1967, to G. N. Chartier, a movable repair tool is disclosed in which a pair of outwardly diverging arms are provided to serve as spaced anchoring points that are placed against a vehicle body part, and a tension chain is positioned between the outwardly extending arms and is connected to the body at a point between the anchoring points so that when the chain is placed under tension the portion of the frame or body between the anchoring points is pulled outwardly until it reaches a predetermined position. The tension is imposed by an hydraulic jack that is carried on a support column, and the other end of the chain is connected to the jack. In U.S. Pat. No. 3,888,100, which issued June 10, 1975, to Finis L. Chisum, there is disclosed a body and frame straightening device that includes a series of rails to which the vehicle is securely connected by means of chains. A plurality of spaced, vertically extending pull posts supported on the rails are provided for applying tensile loads to particular parts of the body or frame by means of tension chains.

In. U.S. Pat. No. 4,398,410, which issued Aug. 16, 1983, to Fred A. McWhorter et al., there is disclosed another form of a pull post that is adapted to be carried on a rectangular frame onto which the vehicle is secured. The pull post is movably carried by the frame so that it can be shifted along the side of a vehicle from the front portion to the rear portion in order to permit the application of a desired pulling force at a desired point on the vehicle frame or body.

In U.S. Pat. No. 4,501,136, which issued Feb. 26, 1985, to Germain Celette, there is disclosed another form of pull post that is essentially free standing and not connected with a rectangular supporting frame. That pull post includes a unitary hydraulic jack for applying a pulling force to a vehicle frame or body.

Although a number of vehicle body and frame straightening devices have been developed, those described above are either excessively complex and expensive, or they are relatively simple, but are limited in their applicability and therefore require excessive time and effort to reset the device in order to permit the number of individual pulls that might be required to straighten a particular part of a vehicle body or frame. In that regard, a roll-cage-type frame structure appears to be the direction in which automobile manufacturers are headed. Such a frame structure is even more difficult to straighten because of the rigidly interconnected crossbars that characterize that design, and it is therefore necessary that simultaneous, accurately placed, plural pulls be employed in order to properly straighten such frames.

Accordingly, it is an object of the present invention to provide an automotive body and frame repair device that is relatively simple and inexpensive, and yet can permit the application of single or plural pulling forces on several areas of a vehicle body or on a vehicle body and frame simultaneously without the need for a complex vehicle supporting frame or structure.

It is a further object of the present invention to permit plural pulling forces to be applied to a vehicle body or frame without requiring frequent movement and resetting of the device.

It is another object of the present invention to overcome the shortcomings of the know vehicle body and frame straightening devices.

SUMMARY OF THE INVENTION

Briefly stated, in accordance with one aspect of the present invention, a vehicle body and frame straightening device is provided which includes a base panel that is movable along a floor surface, and an upright column that extends from the base panel. The upright column is hollow and includes an inner hydraulic jack that is secured in position at one end adjacent to the base portion of the column. A first pulley housing is positioned at the top of the column and includes a first chain guide pulley rotatably carried therein. A second pulley housing is slidably carried on the column for movement therealong, and includes a first central sleeve surrounding the column and slidable there-along, and a second chain guide pulley rotatably carried in the second pulley housing. A chain guide means is provided in the second pulley housing for guiding a chain in a generally horizontal direction relative to the column. A tension chain extends from the free end of the hydraulic jack around the first and second guide pulleys and through the chain guide means for connection to a vehicle frame or body part. Suitable support chains are provided for connection to the column and to floormounted anchor points, to absorb the reaction forces that result when tension is applied to the tension chain.

In accordance with another aspect of the present invention, a device similar to the column described in the preceeding paragraph is provided in which an auxiliary chain connection device is slidably carried on the column for movement therealong. The auxiliary chain connection device includes a second central sleeve, and a pair of opposed, substantially aligned, lateral support bars that extend outwardly from the second central sleeve. At least one connecting link is loosely carried on at least one of the lateral support bars and is movable therealong to a equilibrium position when loads are applied. A stop is provided on the support bar and is spaced outwardly from the second central sleeve to limit outward travel of the connecting link.

BRIEF DESCRIPTION OF THE DRAWINGS

FIG. 2 is a cross-sectional view of the apparatus of FIG. 1, taken along the line 2—2 thereof.

FIG. 3 is a front elevationala view of a movable pulley housing illustrated in FIG. 2.

FIG. 4 is a rear elevational view of the movable pulley housing illustrated in FIG. 2.

FIG. 9 is a front view of a second movable chain guide forming part of the apparatus illustrated in FIG. 8.

FIG. 10 is a top view of the second movable chain guide illustrated in FIG. 9.

FIG. 12 is a top view, similar to FIG. 10, of another embodiment of a movable, outwardly extending chain support that includes a chain guide pulley.

DESCRIPTION OF THE PREFERRED EMBODIMENTS

Figure 1:
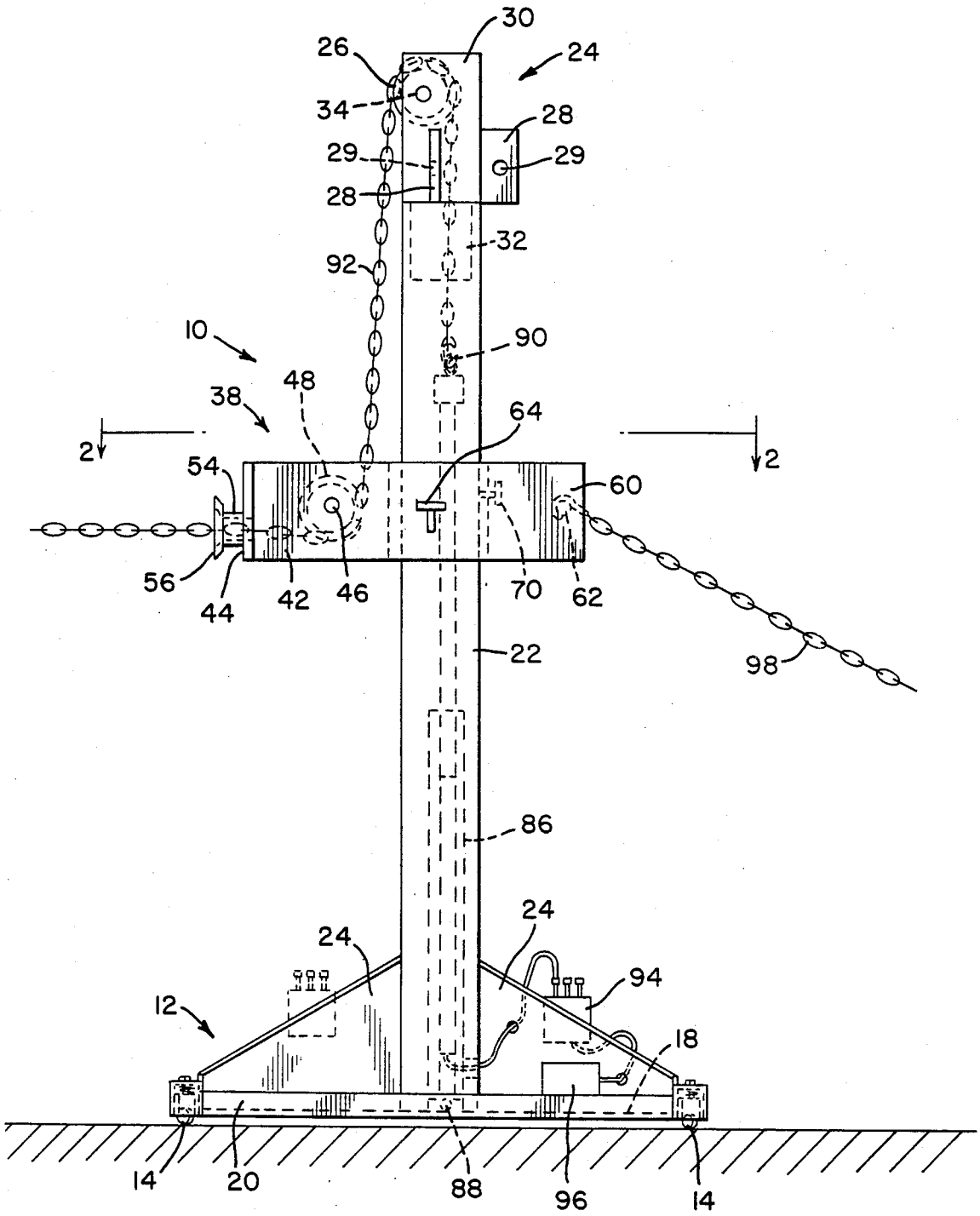
FIG. 1 is side elevational view of one form of body and frame straightening apparatus in accordance with the present invention.

Referring now to the drawings, and particularly to FIGS. 1 and 2 thereof, there is shown one form of automotive body and frame straightening apparatus 10 in accordance with the present invention. The apparatus includes a base 12, that is supported on four casters 14 (only two of which are visible in FIG. 1) for movement along a floor surface 16. Base 12 includes a flat plate-like portion 18 and a surrounding lip or ledge 20 around the outer edges of flat portion 18 for retaining tools and the like. Positioned centrally of base 12 is an upwardly extending column 22 that is hollow and of substantially rectangular cross-section. The lowermost portion of column 22 is secured to plate-like portion 18, such as by welding. Additionally, four gussets 24 (only two of which are visible in FIG. 1) extend outwardly from column 22 toward each of the respective casters 14 to provide lateral support for column 22. Gussets 24 are preferably welded in position to both column 22 and to base plate 12.

Figure 5:
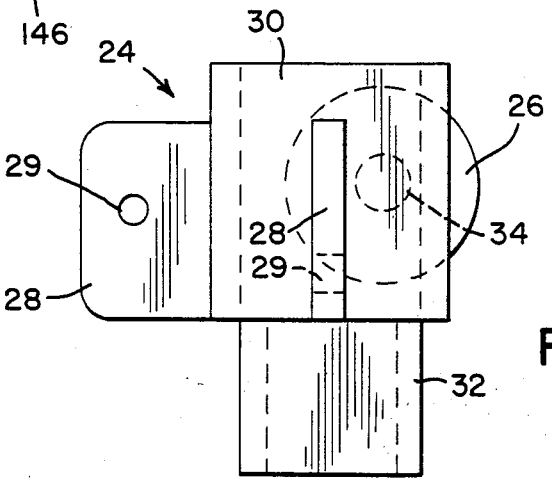
FIG. 5 is a side elevational view of a column top cap assembly for use with the apparatus illustrated in FIG. 1.

A first pulley housing 24 is provided at the uppermost end of column 22 and includes a rotatable drain guide pulley 26, and three outwardly extending chain connection brackets 28 that each include chain connection through holes 29 for attaching a support chain. One bracket is positioned on each lateral side of housing 24 and are on the rearwall thereof. First pulley housing 24 is shown in enlarged detail in FIG. 5 and includes a sleeve 30, from which depends a connector 32 that is adapted to fit within and to be received in the hollow upper end of column 22. Sleeve 30 is generally rectangular, and includes a support shaft 34 that rotatably carries chain guide pulley 26 the purpose of which will be hereinafter described in more detail. Preferably, chain guide pulley 26 is so positioned that its outer periphery is tangential to the central axis of column 22.

Positioned intermediate first pulley housing 24 and base 12 is a second pulley housing 38 that is movable along column 22. The structure of second pulley housing 38 is shown in greater detail in FIGS. 2, 3, and 4. As there shown, second pulley housing 38 includes a sleeve 40 that surrounds column 22, and has a cross-section corresponding with that of the column so that it can be slidably moved therealong. Extending in a first direction outwardly from the sleeve are a pair of opposed, parallel side walls 42 that terminate in a front wall 44. Side walls 42 support a shaft 46 on which a second chain guide pulley 48 is rotatably carried.

Front wall 44 includes an opening 52 that communicates with a tubular guide sleeve 54 that terminates in an outwardly flaring opening 56. Front wall 44 includes a pair of openings 58 on either side of guide sleeve 54 for connection of supporting chains, as will be hereinafter described.

Extending outwardly from sleeve 40 in an opposite direction from second guide pulley 48 are a second pair of opposed, parallel sidewalls 60 that carry a support chain connection rod 62 that is spaced outwardly from sleeve 40 and is substantially parallel with second guide pulley shaft 46. Extending laterally outwardly from sleeve 40 on each side thereof is a T-shaped support chain connection bracket 64 that includes a pair of openings 66 in the upper portion of the T and single opening 68 in the body portion of the T, each opening intended for the connection of additional supporting chains, as may be needed or desired. Additionally, a retaining bolt 70 is provided in one wall of sleeve 40 to bear against column 22 for temporary retention of second pulley housing 38 in a predetermined position prior to the application of loads thereto.

Figure 6:
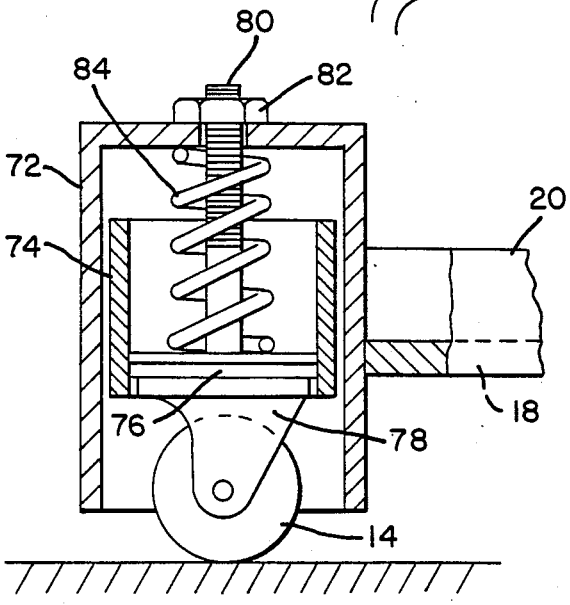
FIG. 6 is an enlarged, fragmentary view, partially in section, of a caster housing included in the apparatus shown in FIG. 1, and in the condition when there is no downward vertical load imposed on the column.
Figure 7:
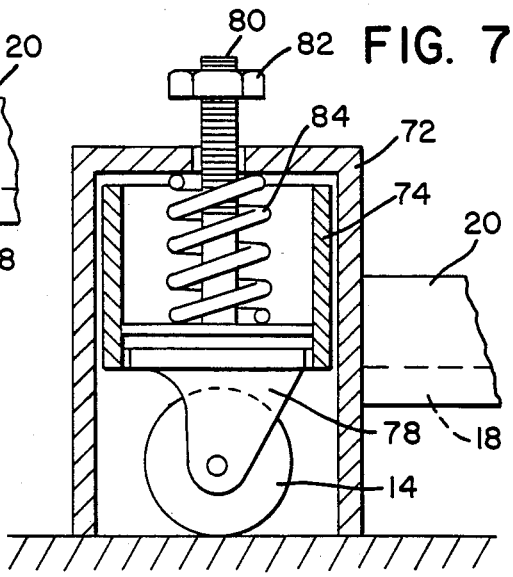
FIG. 7 is an enlarged, fragmentary view, partially in section, of the caster housing shown in FIG. 6 when a downward vertical load is imposed on the column.

Referring now to FIGS. 6 and 7, there is shown a representative caster housing 72 of the type that is positioned at each of the corners of base 12. Caster housing 72 is a generally tubular structure having a closed end, and within which housing an inner tubular guide sleeve 74 is slidably positioned. Guide sleeve 74 includes a transversely mounted plate 76, from which a yoke 78 depends to carry a shaft for rotatably supporting caster 14. A connecting bolt 80 extends upwardly from plate 76 and a travel limiting nut 82 is threaded thereon. A compression spring 84 is positioned to surround connecting bolt 80 and to extend between plate 76 and the inner surface of the top wall of caster housing 72 for urging caster 14 in a downward direction. The respective springs at each of the casters have a sufficiently high spring constant so that the springs space respective caster housings 72 from floor 16 when the apparatus does not have loads applied thereto, so that the apparatus can be easily moved around the floor to a desired position. When loads are applied to the apparatus, as will be hereinafter described, there is a downward force imposed upon column 22 which compresses the respective springs 84, as illustrated in FIG. 7, so that the bottom edges if the respective caster housings 72 contact the floor to prevent lateral movement of the apparatus when it is under a load.

Referring once again to FIG. 1, positioned within hollow column 22 is an hydraulically operated ram or cylinder 86, one end of which is pivotally connected by pivot shaft 88 to the lower portion of column 22 and the other end of which extends upwardly within the column to terminate at a hook-like chain connection point 90. One end of tension chain 92 is connected to connection point 90 and passes around first guide pulley 26 over approximately 180% of arc, and descends along the outer surface of column 22 to second guide pulley 48 to pass around approximately 90% of arc thereof and outwardly through chain guide sleeve 44.

Hydraulic cylinder 86 is suitably connected to a source of pressurized hydraulic fluid through a fluid distribution 94, that is connected with a control housing 96 for controlling the amount and duration of flow of pressurized hydraulic fluid to the cylinder, as is well known to those skilled in the art.

In operation, the outermost end of chain 92 that extends outwardly of chain guide 44 is connected to a vehicle body or frame by means of a hook or other connection device. Preferably, second pulley housing 38 is vertically positioned along column 22 at a point so that the portion of the chain that ex tends outwardly of guide sleeve 44 is aligned with the direction in which the force is desired to be applied to the part to which the chain is attached. Retaining bolt 70 is utilized to temporarily hold second pulley housing 38 in the desired position. At that point a suitable number of supporting chains 98, only one of which is illustrated in FIG. 1, are connected to second pulley housing 38 to absorb the reaction load that results when a tension load is applied to chain 92. Additionally, if desired, further supporting chains can be connected to brackets 28 that extend outwardly from first pulley housing 24. Supporting chains 98 are connected to suitable floor anchor points (not shown).

When a pulling force is desirred to be applied to the vehicle part to which chain 92 is attached, and assuming the vehicle is suitably secured in a fixed position, pressurized hydraulic fluid is caused to flow to cylinder 86 to cause the piston rod to retract into the cylinder, and thereby impose a tension load in chain 92. Cylinder 86 can, for example, be a 10 ton capacity hydraulic cylinder, and the amount of tension in the chain can be suitably controlled by controlling the hydraulic pressure within the cylinder. When sufficient pressure has been generated in the cylinder, the tension in the chain pulls the portion of the frame or body to which the chain is connected and when the desired degree of outward movement of the part has been achieved, the hydraulic pressure is released. While chain 92 is under tension, the supporting chains 98, which are connected between the device and suitable floor anchor points, absorb the reaction forces that result, so that the full tensile load acts upon the part intended to be straightened. As earlier noted, when a load is imposed upon the apparatus, there is a downward force on column 22 that causes caster springs 84 to become compressed so that caster housings 72 contact the floor, as illustrated in FIG. 7.

Figure 8:
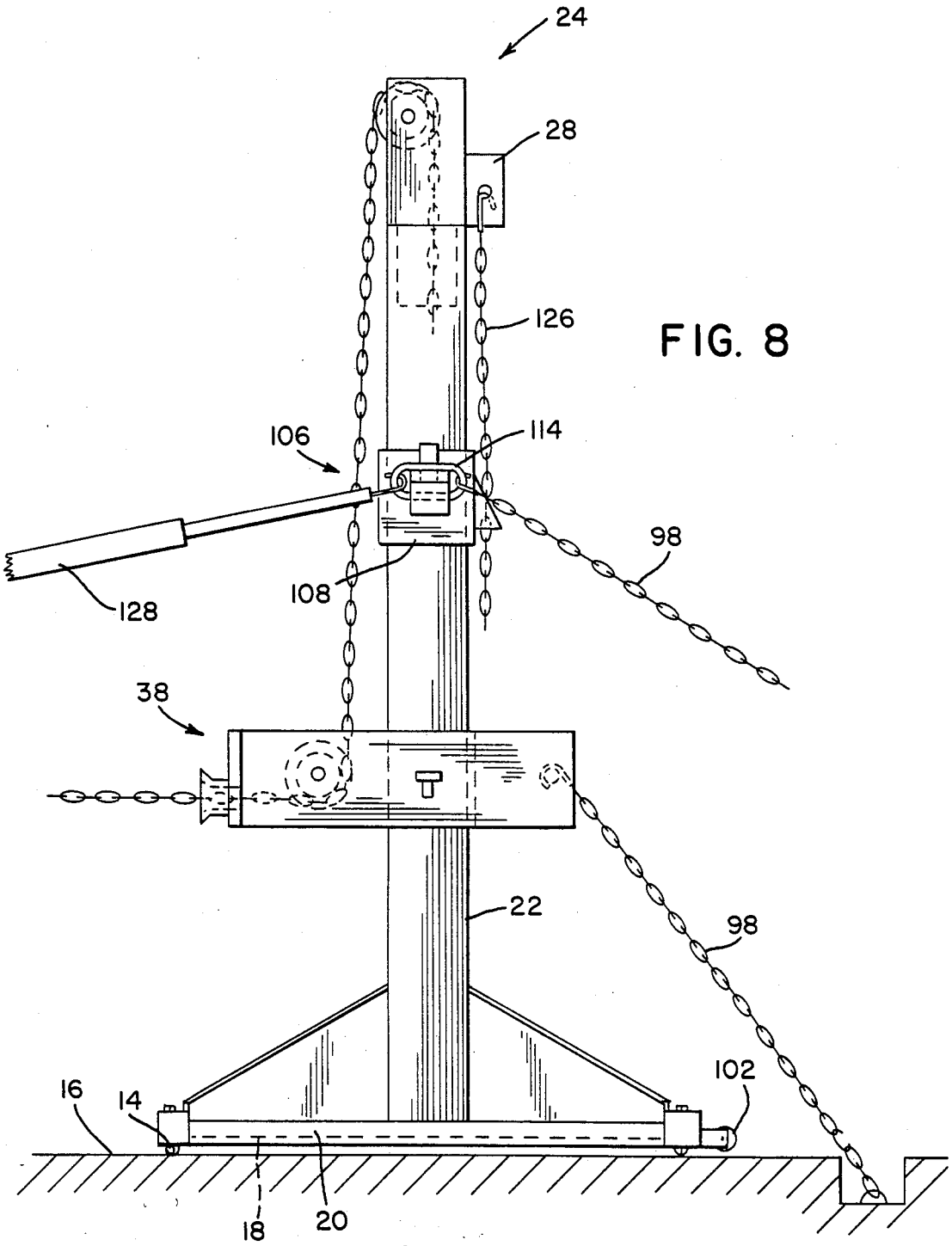
FIG. 8 is a side elevational view of another embodiment of body and frame straightening apparatus in accordance with the present invention.

Referring now to FIG. 8, there is shown another embodiment of the present invention in which the same parts as are illustrated in FIG. 1 bear the same reference numerals. The apparatus as illustrated in FIG. 8 includes rearwardly extending rollers or wheels 102 along one edge of base 12 to permit the apparatus to be rapidly moved from one vehicle to another, by tilting column 22 relative to floor 16. Additionally, FIG. 8 shows the connection of a supporting chain 98 to a floor anchor point 104.

Also shown in FIG. 8 is a movable chain support 106 that includes a sleeve 108 that surrounds column 22, to permit support 106 to be moved along column 22 to a desired position. As best seen in FIGS. 9 and 10, support 106 includes a pair of opposed, outwardly extending arms 110, 112, each of which carries one or more floating connection links 114 in the form of elongated closed loops that are loosely carried on and surround the respective arms so that they can be moved inwardly or outwardly therealong, to a desired position. A series of positioning holes 116 are provided in each of the arms for receiving a supporting pin 118 to limit the movement of the connection links inwardly relative to column 22. Arms 110 and 112 are each supported against downward deflection by respective inclined supporting members 120, 122 that are connected to the respective arms and terminate in and are connected with sleeve 108.

Sleeve 108 carries an accessory wheel 109 on the front face 111 thereof and about which a pull chain can be carried. Wheel 109 is non-rotatably secured to a shaft 113 that is rotatably carried in spaced, parallel support tabs 115, 117. If desired, the structure disclosed can be made so that accessory wheel 109 and shaft 113 are removable from sleeve 108.

A chain connection slot 124 is provided on the rear surface or sleeve 108 to vertically position support 106 in a desired position along the column, as can best be seen in FIG. 8, wherein a supporting chain 126 extends downwardly from the rearwardly extending bracket 28 on first pulley housing 24, with one of the chain links positioned in slot 124 (see FIG. 10) so that the succeeding link bears the downward load of support 106. Additionally, a support chain 98 extends from connection link 114 to a suitable floor anchor point (not shown) and a tension ram 128 is provided for connection to the opposite end of connection link 114, the tension ram adapted to have its free end connected with a portion of a vehicle frame or body (not shown). Tension ram 128 can have a load capacity of 5 tons, if desired. Thus, in the form illustrated in FIG. 8, the present invention permits the application of plural pulling forces on one or more parts of a vehicle frame or body simultaneously, and in a controlled fashion.

Figure 11:
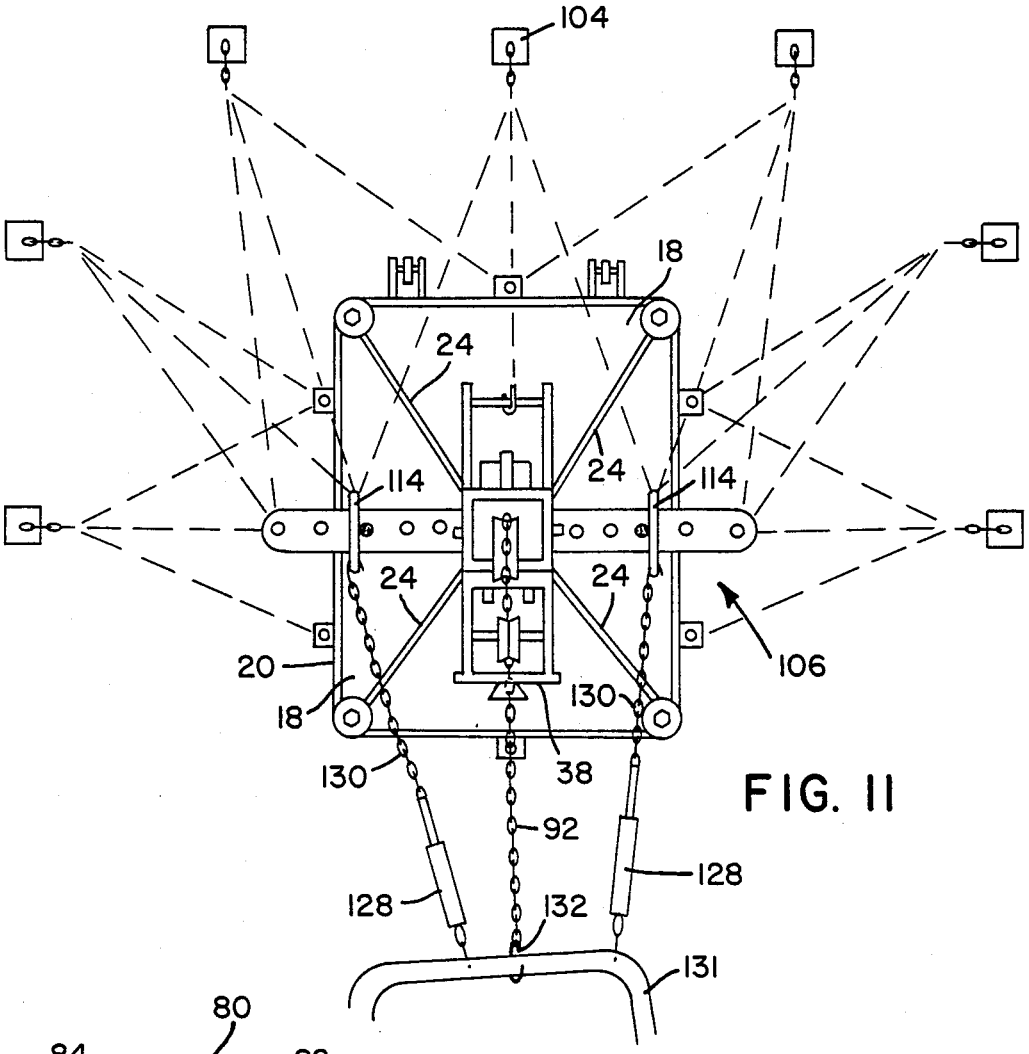
FIG. 11 is a top view of the embodiment illustrated in FIG. 8 showing supporting chains and tension chains in various positions of the device and connected to several floor anchor points.

Referring now to FIG. 11, there is shown the embodiment of FIG. 8, as viewed from above, and while the apparatus is secured to suitable floor anchor points 104, and also to an automotive frame or body 131. As shown, tension chain 92 extends outwardly from pulley housing 38 and is connected to frame portion 131 by means of a hook 132, or the like. Additionally, as shown the apparatus includes a pair of tension rams 128 that are connected to separate points on frame portion 131, and through respective chains 130 to connection links 114 carried on movable chain support 106. Suitable supporting chains, shown in dashed form in FIG. 11, can extend from the opposite ends of connection links 114 to respective ones of the floor anchor points on opposite sides of the apparatus from frame portion 131. The number of supporting chains utilized will depend upon the directions and sizes of the pulling forces that are generated both in the main hydraulic cylinder within the column, as well as the forces generated in the respective tensions rams. The dashed lines in FIG. 11 show a number of possible connections between various points on the apparatus and the respective anchor points, and are for illustrative purposes only. Not all anchors need necessarily be used in a given straightening operation.

Although shown in FIG. 8 as two separate elements, pulley housing 38 and chain support 106 can be combined into a unitary structure as illustrated in FIG. 12. In that arrangement, which does not include accessory wheel 109 and support tabs 115 and 117 shown in FIGS. 9 and 10, there is a common sleeve 134 from which laterally extending arms 110, 112 are supported, in the same manner as illustrated in FIG. 9, and from the forward end of which extends side walls 42 and front wall 44 as illustrated in FIG. 2, together with the rotatable guide pulley 48. The embodiment as illustrated in FIG. 12 permits the application of several tension forces in the same horizontal plane to one or more different parts or portions of the automotive frame or body to be straighted. Thus it is possible, if desired, to simultaneously straighten a frame with the main chain, while the tension rams, or only one of them, can be applied to a fender to simultaneously pull the fender, and at either the same pulling rate, or a different pulling rate, as desired. Thus, simultaneous pulling operations can be easily performed without the necessity for repositioning the apparatus, for which requires additional time and effort.

Figure 13:
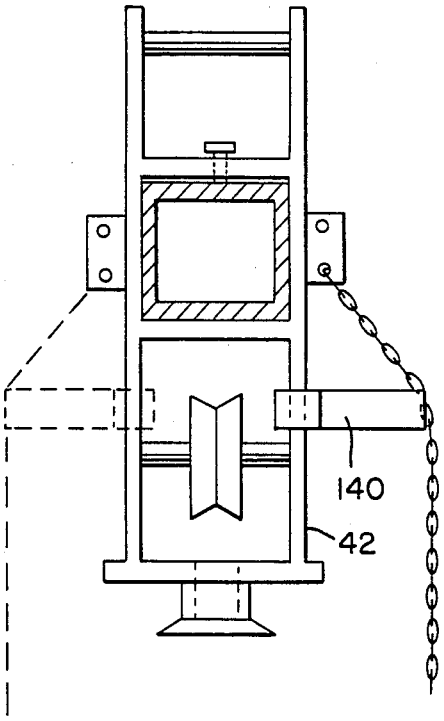
FIG. 13 is a top view, similar to FIG. 2, showing another embodiment of a forwardly extending chain guide and support including a chain standoff.
Figure 14:
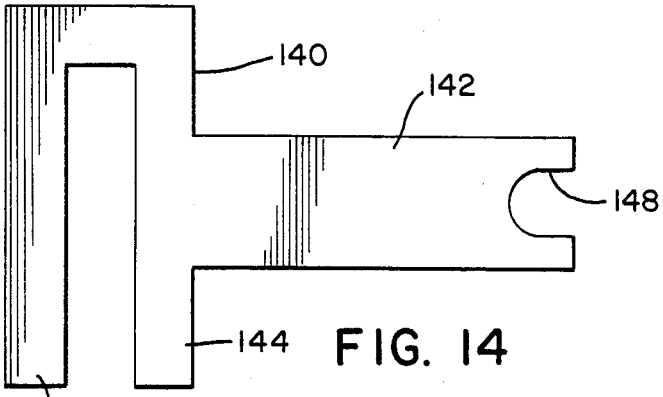
FIG. 14 is an enlarged side view of the chain standoff illustrated in FIG. 13.
Figure 15:
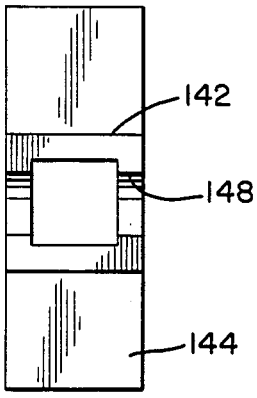
FIG. 15 is an enlarged end view of a chain standoff as illustrated in FIG. 13, as viewed from the right side thereof in FIG. 14.

Referring now to FIGS. 13 through 15, there is shown a variation of the structure illustrated in FIG. 2, in which one or more chain standoffs 140 are provided on pulley housing 38, to laterally outwardly shift the position of an auxiliary tension chain to permit parallel pulling forces to be applied to one or more portions of a vehicle body or frame. Chain standoffs 140 include a body portion 142, and a pair of parallel inner and outer legs 144, 146, respectively that depend from one end of body portion 142 and that are spaced from each other a distance sufficient to permit standoff 140 to be carried on the upper edge of sidewall 42 of pulley housing 38. The opposite end of body portion 142 includes a chain slot 148 for spacing a chain outwardly of a sidewall 42. As best seen in FIG. 15, the chain standoff body portion 142 can be of a hollow construction, if desired, to save weight and cost, and can be of any desired length.

Figure 16:
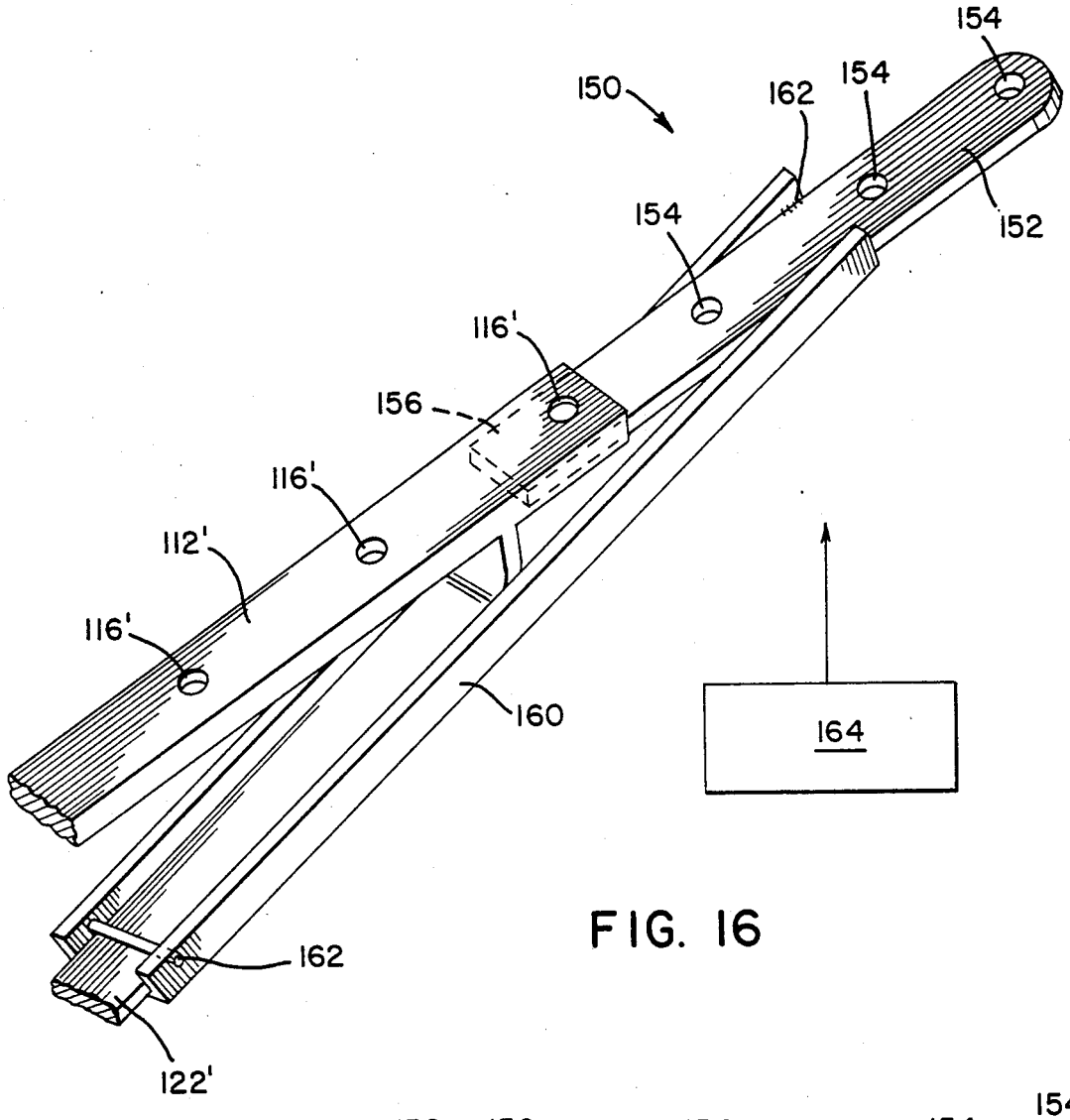
FIG. 16 is a fragmentary perspective view of an extension for use with a modified form of a second movable chain guide as shown in FIGS. 9, 10, and 12.
Figure 17:
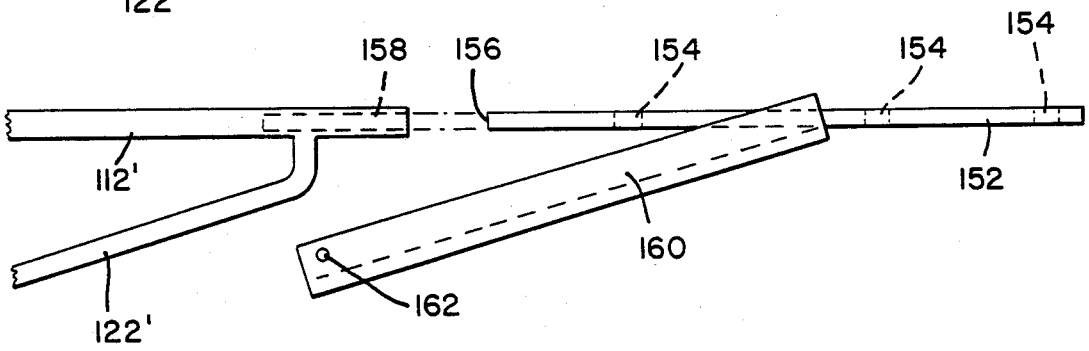
FIG. 17 is a fragmentary side view of the extension shown in FIG. 16 spaced outwardly from the associated second movable chain guide.

As shown in FIGS. 16 and 17, the lateral reach of outwardly extending arms 110 and 112 of movable chain support 106 shown in FIGS. 9 through 12 can be increased by th use of an accessory arm 150, which serves as a removable extension for the arms. Extension arm 152 is in the form of a bar of rectangular cross section and includes a plurality of longitudinally spaced positioning holes 154, that serve the same function as positioning holes 116 shown in FIGS. 9 and 10 by receiving suitable supporting pins to position a floating connection link (not shown). The inner end 156 of extension arm 152 is slidably received in a rectangular slot 158 provided in the outer end of arm 112.

Extension arm 152 is vertically supported by supporting channel 160, and is connected by weld 162, or the like. Channel 160 is of U-shaped in cross section and is adapted to cradle inclined supporting member 112', as shown in FIG. 16. A pin 162 passes laterally through channel 160 at its innermost end and rests against the uppermost surface of supporting member 122' as additional support for extension arm 152.

If desired, vertical support for extension arm 152 can be provided by a support stand 164, or the like, the structure and operation of which is well known to those skilled in the art, with the uppermost portion of the support stand in supporting contact with the lowermost surface of either extension arm 152 or channel 160.

It is therefore apparent from the foregoing description, and the accompanying drawings, that the present invention provides distinct advantages over the devices previously disclosed. In particular, the present invention provides a body and frame straightening device for automotive vehicles that permits the application of simultaneous loads to one or more body or frame parts, the loads being individually controllable, and the direction of the respective pulling forces also being individually controllable. Thus with a single placement of the present device, a number of separate pulling operations can be performed, either concurrently or sequentially, to permit a variety of straightening operations to be quickly and easily performed. Additionally, the present invention permits the application of pulling forces that do not necessarily pass through the axis ofthe column.

Although particular embodiments of the present invention have been illustrated and described, it will be apparent to those skilled in the art that changes and modifications can be made without departing from the spirit of the present invention. It is therefore intended to encompass within the appended claims all such changes and modifications that fall within the scope of the present invention.

What is claimed is:

1. Vehicle body and frame repair apparatus for applying loads to vehicle frames or bodies, said apparatus comprising:

(a) a base;

(b) an upright column having a base portion secured to the base and having a body portion of substantially uniform cross-section terminating in a top portion;

(c) hydraulic jack means carried within the column for applying a pulling force to a vehicle body and having a first end positioned adjacent the base portion of the column and a second, movable end intermediate the ends of the column;

(d) first pulley housing means positioned at the top portion of the column, said first pulley housing means rotatably supporting a first guide pulley;

(e) first tension transmitting means connected with the second end of the hydraulic jack means and extending over the first guide pulley for transmitting a pulling force from the hydraulic jack means to the vehicle body; and (f) second pulley housing means slidably carried on the column for movement along the body portion thereof, said second pulley housing means including a first central sleeve surrounding the column and slidable therealong, a second guide pulley rotatably carried in said second pulley housing, guide means carried by said second pulley housing outwardly from the second guide pulley for guiding the tension transmitting means in a desired direction, a pair of opposed, substantially aligned lateral support bars extending laterally outwardly from opposite sides of the first central sleeve in the direction of the axis of rotation of the second chain guide pulley, connection means carried on at least one of the lateral support bars and movable longitudinally therealong, stop means carried by the lateral support bars and spaced outwardly from the second central sleeve to limit movement of the connecting means relative to the lateral support bar, and second tension transmitting means attached to the connection means for applying an additional pulling force to the vehicle body.

2. Apparatus as claimed in claim 1, wherein the base includes a plurality of wheel means positioned adjacent corners of the base for permitting the device to be moved along a floor surface.

3. Apparatus as claimed in claim 2, wherein the wheel means are movable linearly relative to and toward and away from the base.

4. Apparatus as claimed in claim 2, wherein the base includes transit rollers along one edge thereof and spaced inwardly from wheel means carried at corners of the base.

5. Apparatus as claimed in claim 1, wherein the upright column is of tubular construction.

6. Apparatus as claimed in claim 5, wherein the column has a rectangular cross section.

7. Apparatus as claimed in claim 1, wherein the first pulley housing is removably carried on the column.

8. Apparatus as claimed in claim 1, wherein the first pulley housing includes a plurality of support chain brackets extending outwardly therefrom for permitting connection of supporting chains to the first pulley housing.

9. Apparatus as claimed in claim 1, wherein the first pulley is positioned so that its periphery is substantially tangential to the longitudinal axis of the column.

10. Apparatus as claimed in claim 1, wherein the second pulley housing includes pair of opposed side walls extending outwardly of the first central sleeve, wherein the opposed side walls rotatably support the second chain guide pulley, and standoff arm means extending outwardly from at least one side wall if the first central sleeve for spacing a pull chain outwardly of the sidewall.

11. Apparatus as claimed in claim 10, wherein the opposed side walls extend from the sleeve in opposite directions relative to the body portion of the upright column, and the side walls include supporting chain connection rod means on the opposite side of the sleeve from the second chain guide pulley.

12. Apparatus as claimed in claim 11, including outwardly extending bracket means connected with the first central sleeve and extending outwardly therefrom in opposed relationship.

13. Apparatus as claimed in claim 10, wherein the standoff arm means are removable and are slidable along at least one side wall to a desired position.

14. Apparatus as claimed in claim 10, including retaining means carried by the first central sleeve for limiting movement of the second pulley housing along the column.

15. Apparatus as claimed in claim 1, wherein the connection means includes a connection link loosely carried on the lateral support bar.

16. Apparatus as claimed in claim 1, wherein the stop means are adjustable along the lateral support bar.

17. Vehicle body and frame repair apparatus for applying loads to vehicle frames or bodies, said apparatus comprising:

(a) a base;

(b) an upright column having a base portion secured to the base and having a body portion of substantially uniform crosssection terminating in a top portion;

(c) hydraulic jack means carried along the column and having a first end positioned adjacent the base portion of the column and a second, movable end intermediate the ends of the column;

(d) first pulley housing means positioned at the top portion of the column, said housing means rotatably supporting a first chain guide pulley;

(e) first tension transmitting means connected with the second end of the hydraulic jack means and extending over the first chain guide pulley for transmitting a pulling force from the hydraulic jack means to the vehicle body;

(f) second pulley housing means slidably carried on the column for movement along the body portion thereof, said second pulley housing means including a first central sleeve surrounding the column and slidable therealong, a second chain guide pulley rotatably carried in said second pulley housing means, and chain guide means carried by said second pulley housing outwardly from the second chain guide pulley for guiding a chain in a desired direction; and (g) auxiliary chain connection means extending outwardly from the column in opposed relationship and slidably carried on the column for movement along the body portion thereof, the auxiliary chain connection means including a second central sleeve, and a pair of opposed, substantially aligned lateral support bars extending laterally outwardly from the second central sleeve, at least one connection link loosely carried on a lateral support bar and movable therealong, and adjustable stop means on said support bars and spaced outwardly from the second central sleeve to limit outward travel of the at least one connecting link, and second tension transmitting means attached to the connection means for applying additional pulling loads to the vehicle.

18. Vehical body and frame repair apparatus for applying loads to vehicle frames or bodies, said apparatus comprising:

(a) a base;

(b) an upright column having a base portion secured to the base and having a body portion of substantially uniform crosssection terminating in a top portion;

(c) hydraulic jack means carried along the column and having a first end positioned adjacent the base portion of the column and a second, movable end intermediate the ends of the column;

(d) first pulley housing means positioned at the top portion of the column, said housing means rotatably supporting a first chain guide pulley;

(e) first tension transmitting means connected with the second end of the hydraulic jack means and extending over the first guide pulley for transmitting a pulling force from the hydraulic jack means to the vehicle body;

(f) second pulley housing means slidably carried on the column for movement along the body portion thereof, said second pulley housing means including a first central sleeve surrounding the column and slidable therealong, a second chain guide pulley rotatably carried in said second pulley housing means, and chain guide means carried by said second pulley housing means outwardly from the second chain guide pulley for guiding a chain in a desired direction, wherein the second pulley housing means includes a pair of opposed, substantially aligned, lateral support bars extending laterally outwardly from the first central sleeve, at least one connecting link carried on a lateral support bar and movable along the bar, and adjustable stop means on the support bar and spaced outwardly from the second central sleeve to limit outward travel of the at least one connection link, and second tension transmitting means attached to the connection means for applying an additional pulling force to the vehicle body.

19. Apparatus as claimed in claim 18, including extension arm means carried by at least one of the lateral support bars and extending laterally outwardly therefrom, the extension arms means having adjustable stop means to limit outward travel of the connection link.

* * * * *